US005770784A

United States Patent [19]

Heywood et al.

[11] Patent Number: 5,770,784

[45] Date of Patent: Jun. 23, 1998

[54] SYSTEMS FOR THE TREATMENT OF COMMINGLED WASTES AND METHODS FOR TREATING COMMINGLED WASTES

[75] Inventors: Ann C. Heywood, Danville; Mark R. Holst, Concord; Richard J. Martin, San Jose, all of Calif.; John T. Schofield, Villanova, Pa.

[73] Assignee: Thermatrix, Inc., San Jose, Calif.

[21] Appl. No.: 789,271

[22] Filed: Jan. 28, 1997

Related U.S. Application Data

[63] Continuation-in-part of Ser. No. 631,708, Apr. 10, 1996, abandoned.

[51] Int. Cl.[6] ..... F23D 3/40

[52] U.S. Cl. ..... 588/209; 588/213; 588/216; 588/220; 588/228

[58] Field of Search ..... 588/209, 213, 588/216, 220, 228

[56] References Cited

U.S. PATENT DOCUMENTS

| | | | |
|---|---|---|---|
| 4,463,691 | 8/1984 | Meenan et al. | 110/346 |
| 4,688,495 | 8/1987 | Galloway | 110/250 |
| 4,823,711 | 4/1989 | Kroneberger et al. | 110/236 |
| 5,165,884 | 11/1992 | Martin et al. | 431/7 |
| 5,188,041 | 2/1993 | Noland et al. | 110/246 |
| 5,320,518 | 6/1994 | Stilger et al. | 431/7 |
| 5,409,617 | 4/1995 | Ross et al. | 210/762 |
| 5,434,337 | 7/1995 | Kiss | 588/205 |
| 5,533,890 | 7/1996 | Holst et al. | 431/5 |
| 5,603,684 | 2/1997 | Wetmore et al. | 588/252 |

OTHER PUBLICATIONS

Battleson, D. et al., "Latest Minimum Additive Waste Stabilization and Buried Waste Integrated Demonstration Test Results on the Plasma Centrifugal Furnance", Proceedings, Thirteenth International Incineraiton Conference, U.C. Irvine, May, 1994, pp. 349–354.

Herbst, C.A., "Quantum–Catalytic Extraction Process Application to Mixed Waste Processing", International Nuclear and Hazardous Waste Management Conference, Atlanta, GA, Aug. 14–18, 1994.

Mansour, M. et al., "MTCI/Thermochem Steam Reforming Process for Biomass", Proceedings, Second Biomass Conference of the Americas: Energy, Environment, Agriculture, and Industry; National Renewable Energy Lab, Aug. 21, 1995, Portland, ORE.

*Primary Examiner*—Arun S. Phasge

*Attorney, Agent, or Firm*—Woodcock Washburn Kurtz Mackiewicz & Norris LLP

[57] ABSTRACT

Improved methods for the treatment of commingled wastes and process systems for practicing those methods are provided. The methods are practiced by first treating the commingled waste material in a primary treatment unit in the presence of a carrier fluid to separate the organic waste from the inorganic waste. The carrier fluid and the gaseous products from the primary unit are then treated in a flameless oxidizer, which efficiently destroys any remaining organic compounds. In one embodiment, the process gases exiting the flameless oxidizer are recycled to the primary treatment unit.

34 Claims, 3 Drawing Sheets

SYSTEMS FOR THE TREATMENT OF COMMINGLED WASTES AND METHODS FOR TREATING COMMINGLED WASTES

This is a continuation-in-part application of U.S. application Ser. No. 08/631,708, filed Apr. 10, 1996 now abandoned.

FIELD OF THE INVENTION

The present inventions relate to systems and methods for the treatment of commingled wastes. More specifically, the present inventions relate to improved techniques for treating the volatile organic compounds produced by the initial treatment of commingled wastes.

BACKGROUND OF THE INVENTION

The treatment of commingled, or mixed, hazardous wastes is a challenging problem facing environmental engineers today. Commingled wastes typically consist of liquid and/or solid wastes that contain both organic and inorganic components. The wastes are defined as being hazardous under applicable governmental regulations. These wastes can also include low-level radioactive materials. Examples of commingled wastes include sludges containing a combination of electroplating wastes and organic solvents, paint removal wastes resulting from sandblasting of organic coatings that contain lead or copper, ion exchange resins, protective clothing (containing natural or synthetic organic material) that is contaminated with low-level radioactive compounds, and soils that contain any combination of hazardous and/or radioactive organic and/or inorganic compounds.

The principal difficulty in dealing with commingled wastes is the inability of a single treatment method to render both the inorganic and organic wastes non-hazardous. To address this difficulty, research has led to the design of multiple unit operations in the overall treatment system.

Current treatment systems are designed to include a primary partitioning unit, wherein the organic wastes are separated from the inorganic wastes. These systems further include one or more secondary treatment steps to reduce or eliminate the hazardous nature of the wastes.

The separation of the organic wastes from the inorganic wastes within the primary partitioning unit is commonly effected by a thermal decomposition or stripping step. In this step, the commingled waste is heated to a temperature sufficient for the organic material to enter the gaseous state, by vaporization and/or decomposition, thereby leaving behind the non-volatile inorganic fraction.

The primary partitioning units are typically operated under such conditions that a significant portion of the organic compounds are at least partially, if not fully, oxidized.forming such compounds as CO, $H_2$, $CO_2$, and $H_2O$. Indeed, it is beneficial for these units to destroy the organic content of the waste material to lessen the burden on any downstream processing units used to remove the organics from the gaseous stream prior to emitting the stream into the atmosphere.

The subsequent secondary treatment of the inorganic fraction often involves a stabilization process. Typical processes include the encapsulation of the inorganic waste in a cementitious or glass matrix.

The subsequent secondary treatment of the organic fraction is typically conducted by adsorbing the organic compounds on an adsorbent, such as activated carbon, or by destroying the organic compounds in a flame incinerator. The use of activated carbon is disadvantageous due to the need to replace the carbon filters and the costs associated therewith. The use of flame incinerators is disadvantageous due to the requirement for excessive amounts of processing air to accomplish effective destruction of the organic waste with the concomitant production of larger quantities of pollutant gases that must be further processed prior to release to the atmosphere. Thus, there exists a need to design improved secondary treatment systems to handle the organic compounds generated by the primary partitioning unit.

SUMMARY OF THE INVENTION

The present invention provides improved methods for treating commingled waste materials and process systems for practicing those methods. The commingled wastes contain a mixture of both organic and inorganic materials, and are commonly regulated as containing hazardous and/or low level radioactive wastes. The improved methods serve to more efficiently purify the gaseous organic waste stream generated during the treatment of commingled wastes by thoroughly oxidizing volatile organic compounds (VOCs) and carbon monoxide (CO).

In one embodiment of the methods of the present invention, a commingled waste stream is fed into a primary treatment unit. Examples of conventional primary treatment units include, but are not limited to, plasmaarc centrifugal furnaces, vitrification furnaces, steam reformers, molten metal/salt processors, hydrothermolytic processors, and aqueous decomposition processors. The primary treatment unit serves to separate virtually all of the organic material from the inorganic material in the commingled waste and to partially decompose the organic material. A carrier fluid is also introduced into the primary treatment unit both as a reactant and to entrain the gaseous products created in the primary treatment unit. An organic gas stream comprising at least CO or VOCs and the carrier fluid is thereby created within the primary treatment unit. The organic gas stream is removed from the primary treatment unit and fed into a first portion of a matrix bed of heat resistant material contained within a flameless oxidizer and maintained at a temperature of at least 1400° F. Any VOC or CO compounds are thereby oxidized into gaseous products in an oxidation wave that is established within the first portion of the matrix bed.

A preferred embodiment of the methods of the present invention includes recycling at least a portion of the carrier fluid from the flameless oxidizer back to the primary treatment unit. This recycling loop would reduce processing costs by decreasing the load on any downstream processing of the gaseous products exiting the flameless oxidizer prior to their release to the atmosphere.

It is also preferred to heat the first portion of the matrix bed by means of an electric heater. In such a way, there is no need to supplement the gaseous product stream exiting the primary treatment unit with fuel to maintain a proper temperature within the flameless oxidizer. Consequently, the amount of process gases exiting the flameless oxidizer is reduced and this will lessen the burden on downstream processing units. Also, it is preferred to supplement the gaseous product stream exiting the primary treatment unit with oxygen instead of air, if necessary at all, for the same reason.

The present invention also provides for process systems for treating commingled waste. These systems include a primary treatment unit as described above that has a gaseous outlet in flow communication with the flameless oxidizer inlet. The flameless oxidizer contains a matrix bed of heat resistant material and a heater for heating a portion of the matrix bed to a temperature of at least about 1400° F. The process system can further include a recycle gas loop in flow communication with the outlet of the flameless oxidizer and the inlet for the primary treatment unit for recycling a portion of the carrier fluid.

In another embodiment of the present invention, the method of destroying the organic compounds present in the waste stream is practiced in a manner to shift the function of decomposing (either by oxidation or reduction) the organic compounds away from the primary treatment unit and to the flameless oxidizer, which is significantly more efficient at destroying organic compounds than the primary treatment units. This preferred method is conducted when the primary treatment unit is an aqueous-based treatment unit, such as a steam reformer, a hydrothermolytic processor, or an aqueous decomposition processor. In this embodiment, the aqueous-based primary treatment unit functions primarily to separate the organic compounds from the non-organic compounds within the waste stream. The aqueous-based primary treatment unit is operated under such conditions that it decomposes, either partially or fully, less than about 50%, preferably less than 25%, and more preferably less than 10%, by volume of the organic compounds within the waste stream to such decomposition products as CO, $CO_2$, $H_2$, and $H_2O$. The primary treatment unit, if already on-line, can thereby be operated beyond its normal design capacity or, if the system has not yet been constructed the primary treatment unit can be designed as a smaller unit, because it does not have to fully oxidize the organic compounds. This method of operation can further include the use of an encapsulation unit downstream of the primary treatment unit (and parallel to the flameless oxidizer) to dispose of the non-organic portion of the waste stream. Encapsulation units can include a plasma-arc centrifugal furnace, a vitrification furnace, a molten metal/salt processor, and a process whereby the waste is stored in a suitable containment vessel.

DETAILED DESCRIPTION OF THE INVENTION

The present invention provides systems for the improved treatment of commingled wastes, which contain an organic and an inorganic waste component. The treatment systems contain a primary treatment unit into which the commingled wastes are fed as an initial treatment step. The primary treatment unit can be selected from any of several conventional technologies, such as plasma-arc centrifugal furnaces, vitrification furnaces, steam reformers, molten metal/salt processors, hydrothermolytic processors, and aqueous decomposition processors. These primary treatment units serve to separate the organic and inorganic wastes and also to partially decompose the organic waste components. The decomposition of the organic waste components is accomplished by either oxidation or reduction. A carrier fluid is also introduced into the primary treatment unit both as a reactant and to entrain the gaseous products created in the primary treatment unit. An organic gas stream comprising various gases such as $H_2$, CO, $CO_2$, $H_2O$, and volatile organic compounds (VOCs) that were not oxidized in the primary treatment unit, along with the carrier fluid, is thereby created within the primary treatment unit.

In the present invention, the gaseous waste stream is transferred from the primary treatment unit to a second treatment unit that is a flameless oxidizer. The flameless oxidizer functions to oxidize the VOCs in the organic waste stream and to reduce the VOC content to acceptably low levels.

Commingled wastes are defined herein as those wastes that contain both organic and inorganic components. Such wastes typically contain hazardous and/or low level radioactive materials. Examples of commingled wastes include sludges containing a combination of electroplating wastes and organic solvents, paint removal wastes resulting from sandblasting of organic coatings that contain lead or copper, ion exchange resins, protective clothing (containing natural or synthetic organic material) that is contaminated with low-level radioactive compounds, and soils that contain any combination of hazardous and/or radioactive organic and/or inorganic compounds.

Figure 1:
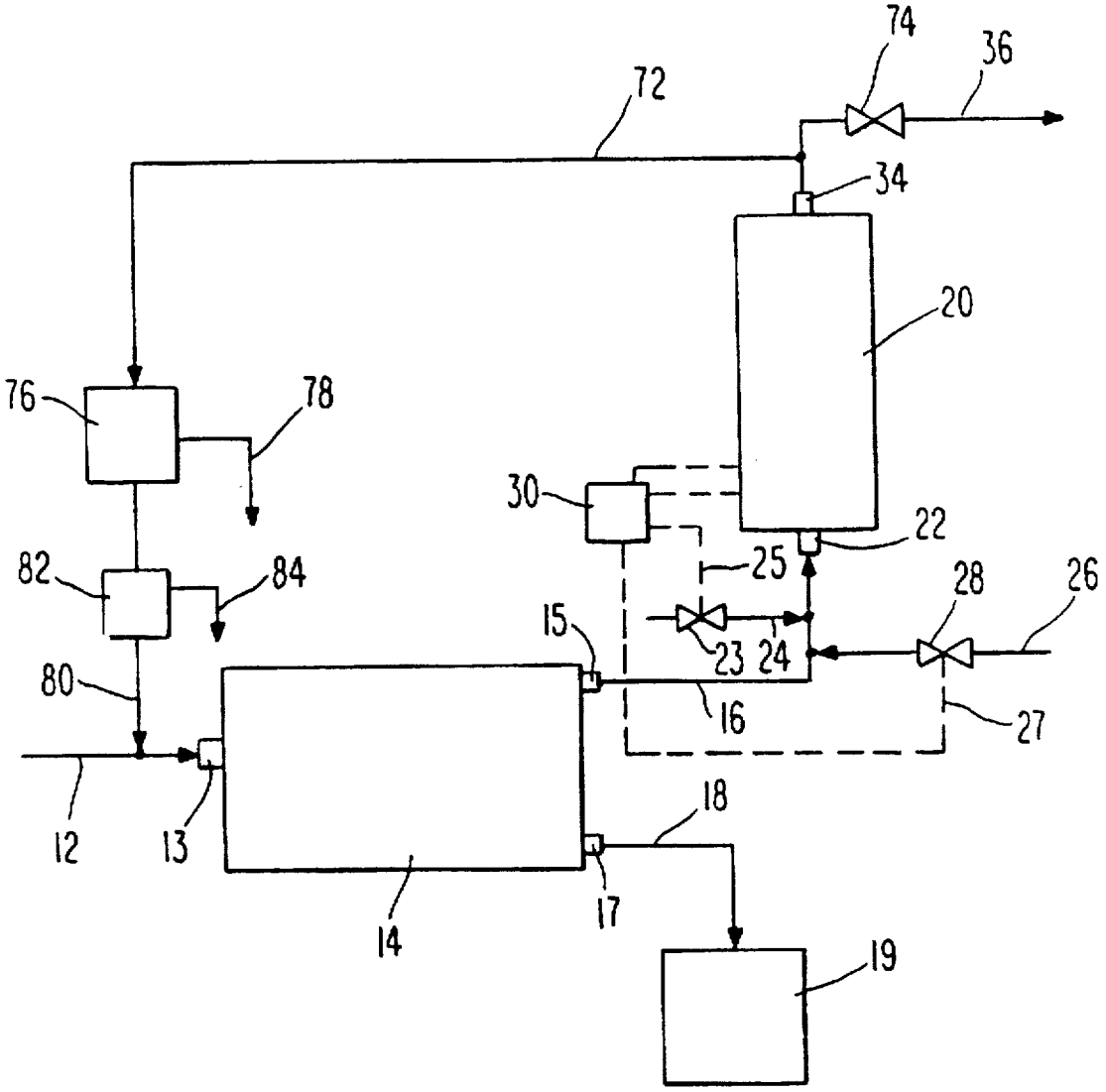
FIG. 1 is a schematic representation of the processing system of the present invention.

One embodiment of a system of the present invention is shown in FIG. 1. A commingled waste stream (12), containing commingled waste material, is fed into the inlet (13) of a primary treatment unit (14). The primary treatment unit (14) functions to separate the organic and inorganic components of the commingled waste. The primary treatment unit (14) generally will also oxidize a portion of the organic compounds present in the commingled waste. Various types of processors can be used to function as the primary treatment unit (14).

One group of primary treatment units are those that employ a molten material to burn or oxidize the organic components and to encapsulate the inorganic material. One example of such a unit is a plasma-arc centrifugal furnace, such as those described in "Latest Minimum Additive Waste Stabilization and Buried Waste Integrated Demonstration Test Results on the Plasma Centrifugal Furnace," Battleson, D. et al. (1994). These units can further include fired and induction vitrification furnaces. The molten material, which can include glass compounds and other inorganic molten materials such as oxides of calcium, aluminum, silicon, and iron, is drained off to remove the encapsulated inorganic materials. The commingled waste is fed into these units along with make-up materials that constitute the molten material. Additives may also be combined with the solid feed materials to enhance the properties of the molten material. The gaseous stream that exits these units requires further treatment. However, these units are capable of destroying a substantial fraction of the organic waste material. The exiting gas will generally contain $H_2$, CO, $CO_2$, $N_2$, $H_2O$, and VOCs. The exiting gas is at temperatures of between about 200° F. and about 1500° F., more commonly between about 500° F. and 1000° F. The carrier fluid for such systems is typically air.

A second example of a primary treatment unit is a steam reformer, such as those described in "MTCI/Thermochem Steam Reforming Process for Biomass," Mansour, M. N., et al. (1995). Such systems generally have a fluidization vessel that contains a bed of limestone. The commingled waste is introduced into the fluidization vessel along with high temperature steam. The organic waste is partially oxidized and forms an exiting gas stream containing $H_2O$, $H_2$, CO, $CO_2$, and VOCs. This gas stream is at a temperature of between about 200° F. and 1200° F., more commonly between about 600° F. and 1200° F. The carrier fluid for this type of system is steam. The inorganic wastes are removed in a solid waste stream.

A third example of a primary treatment unit is a molten metal\salt extraction processor, such as those described in "Quantum-Catalytic Extraction Process Application to Mixed Waste Processing," Herbst, C. A., et al., (1994). Such processors contain a molten metal bath that acts as a catalyst and as a solvent in the dissociation of the feed, the synthesis of products and/or the concentration of radionuclides in a desired phase. The organic materials are separated from the commingled waste and form an exit gas stream containing $H_2$, CO, $CO_2$, and VOCs. This gas stream is at a temperature of between about 200° F. and 1500° F., more commonly between about 500° F. and 1200° F. A typical carrier fluid for this type of system either air, $O_2$, $N_2$, or a combination thereof. The inorganic waste materials are concentrated in various molten waste streams.

A fourth example of a primary treatment unit is a hydrothermolytic processor, such as those described in U.S. Pat. No. 5,409,617 to Ross et al. These systems process the commingled waste with near-critical water at moderately high temperatures, generally from about 400–925° F., and high pressures, generally between about 10 and 400 atmospheres, to mobilize the organic component of the waste material. The presence of dilute concentrations of various catalytic species in the water also serves to partially oxidize the organic components. The resultant organic waste stream generated by this system contains $H_2$, CO, $CO_2$, $N_2$, $O_2$, $H_2O$ and VOCs. This gas stream is at a temperature of between about 200° F. and 800° F. The carrier fluid for this system is steam/water vapor. A solid waste stream containing primarily the inorganic waste components is also formed and removed separately.

A final example of a primary treatment unit is an aqueous decomposition processor. In such a system the commingled waste, which is typically a water soluble material, is admixed with an electrolytic aqueous solution that can either oxidize or reduce the organic contaminants in the waste feed to form more benign or more easily separable constituents. The aqueous solution is generally at ambient (20°–25° C.) conditions. The aqueous solution containing the waste material is then flashed through a nozzle to vaporize the water and any organic compounds in the commingled waste. The exiting gaseous stream generated by this system contains $H_2$, CO, $CO_2$, $N_2$, $O_2$, $H_2O$ and VOCs. This gas stream is at a temperature of between about 150° F. and 250° F. The carrier fluid for this system is water vapor.

As shown in FIG. 1, a gaseous stream exits from the primary treatment unit (14) through outlet (15) and is transported from that unit via line (16). The primary treatment units (14) described herein generally operate to destroy anywhere from about 20–99% by volume of the organic compounds in the commingled waste. The organic compound content in the exiting gaseous stream within line (16) generally contains from about 0.01 to about 10% by volume VOCs. The waste stream containing the inorganic component of the commingled waste is removed from the primary treatment unit (14) through outlet (17) via line (18) and can be further treated in accordance with conventional practices.

The exiting gaseous stream from the primary treatment unit (14) is then further treated in a flameless oxidizer (20). The gaseous stream enters the flameless oxidizer (20) through inlet (22). Prior to entering the flameless oxidizer, supplemental air can be injected into the gaseous stream via line (24) or supplemental fuel, such as natural gas or propane, can be injected into the gaseous stream via line (26). The rates of addition of the supplemental air and/or fuel can be regulated through use of a process controller (30) that is electronically wired to a control valve (23) on the air line (24) and to a control valve (28) on the fuel line (26), via lines (25) and (27), respectively. The supplemental fuel and/or air are used to maintain an oxidation wave within the flameless oxidizer (20) and, in some cases, to adjust the temperature of the gaseous stream entering the oxidizer.

Significant research into the phenomena of oxidation within porous inert media (PIM) has recently been undertaken. Because PIM oxidation can occur outside the normal premixed fueled/air flammability limits, the technology can be called "flameless." In this regard U.S. Pat. Nos. 4,688,495 (Galloway) and 4,823,711 (Kroneberger et al.) disclose early work on matrix oxidation technology. In addition, U.S. Pat. Nos. 5,165,884 (Martin et al.) and 5,320,518 (Stilger etal.), and allowed application Ser. No. 08/393,023 (Hoist et al.), filed Feb. 23, 1995, now U.S. Pat. No. 5,533,890 discuss in significant detail the technology involved in the designing of a flameless oxidizer (20). The issued Martin et al., Hoist et al, Stilger et al., Galloway, and Kroneberger et al. patents are hereby incorporated in their entireties by reference.

Figure 2:
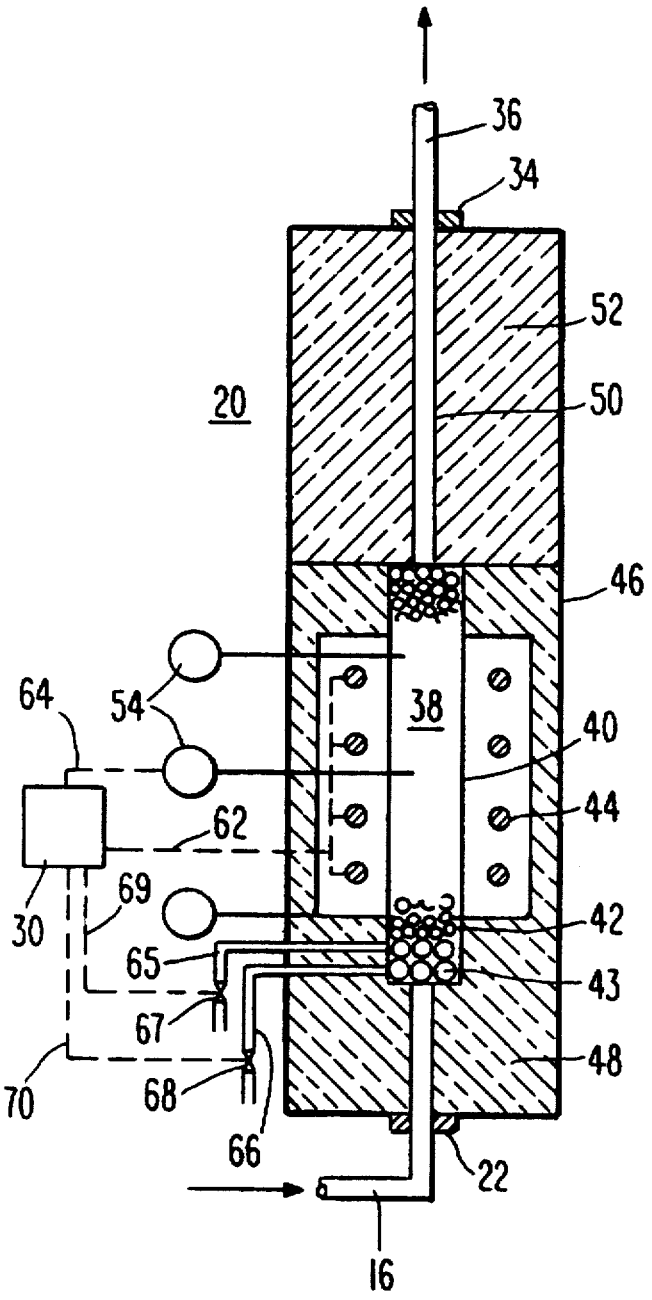
FIG. 2 is a cross-sectional schematic of an embodiment of the flameless oxidizer of the present invention.

An embodiment of a flameless oxidizer (20) is shown in FIG. 2. Typically, the flameless oxidizer (20) will consist of a high-alloy matrix bed containment shell (40) that is filled with a quantity of heat resistant material (42) so as to create a matrix bed (38). The containment shell (40) will preferably be of sufficient mechanical strength to prevent rupture even in the event of a detonation generating significant pressures. Heating elements (44), which are preferably electric, surround this inner containment shell (40) and are capable of providing the system with preheating and proper temperature maintenance during operation.

The entire thermal oxidation assembly will be mounted in an outer containment shell (46), preferably made of carbon steel. This outer containment shell (46) is preferably lined with high temperature insulation (48) in the entirety of the region of the matrix bed containment shell (40).

Upon entering the flameless oxidizer (20), the gaseous stream will be raised to oxidation temperatures of 1400°–3500° F.(760°–1925° C.), and preferably 1550°–1800° F. (845°–980° C.), by the heat input from the heating elements (44). The gaseous stream is then maintained at these temperatures for a sufficient residence time to ensure substantially complete destruction of any remaining VOCs and for the substantially complete conversion of CO to $CO_2$. The destruction efficiency of the flameless oxidizer is at least about 99%, preferably at least about 99.9%, and more preferably at least about 99.99%, by weight. That is, at least that percent by weight of all organic compounds entering the flameless oxidizer are destroyed, or oxidized, within the oxidizer. In normal operation, it is contemplated that this residence time will be less than 2.0 seconds, and preferably less than 0.5 seconds.

In one preferred configuration, the heating elements (44) around the matrix bed (38) may be grouped into two sets, one set making up an electrical preheater section that raises the temperature of the gases to the autoignition point and allows them to react, and a second set making up a residence time section where the heating elements (44) are adjusted so as to just offset the ambient losses and allow the processed gases to complete oxidation at temperature.

The result of this heating is the creation of a flameless oxidation wave within the matrix bed (38) whereby the VOC compounds are ignited and oxidized to stable products, such as water and carbon dioxide. The oxidation wave is observed as a steep increase in bed temperature from the temperature of the incoming gases on the inlet side of the wave to approximately the adiabatic combustion temperature of the mixture on the outlet side of the wave. This rapid change takes place over a distance of usually several inches in a typical oxidizer (20), with the actual distance being dependent upon feed concentrations, feed rates, gas velocity distribution, bed material, and bed physical properties, type of specific feed materials, etc. Heat losses in the direction of flow also will have an effect on the length of the oxidation wave.

The temperature of the oxidation is dependent upon feed concentrations, feed rates, gas velocity distribution, bed physical properties, type of specific feed materials, heat losses, heat input from the heaters, etc.

After thorough destruction in the flameless oxidizer (20), the resulting gaseous products will exit the flameless oxidizer through oxidizer outlet (34) via line (36).

In the embodiment of FIG. 2, the matrix bed containment shell (40) terminates and a convective quench stream (50) passes through a length of quench insulation (52) before exhausting in gaseous products line (36). The quench insulation (52) can be the same as or different from the high temperature insulation (48), although it is preferably different in that it has a different heat conductivity. The high temperature insulation (48) is designed to have low heat conductivity so as to minimize heat losses from the matrix bed (38). The quench insulation (52), on the other hand, has a slightly higher heat conductivity, designed to reduce the temperature of the outlet gas from the flameless oxidizer to a desired value.

Figure 3:
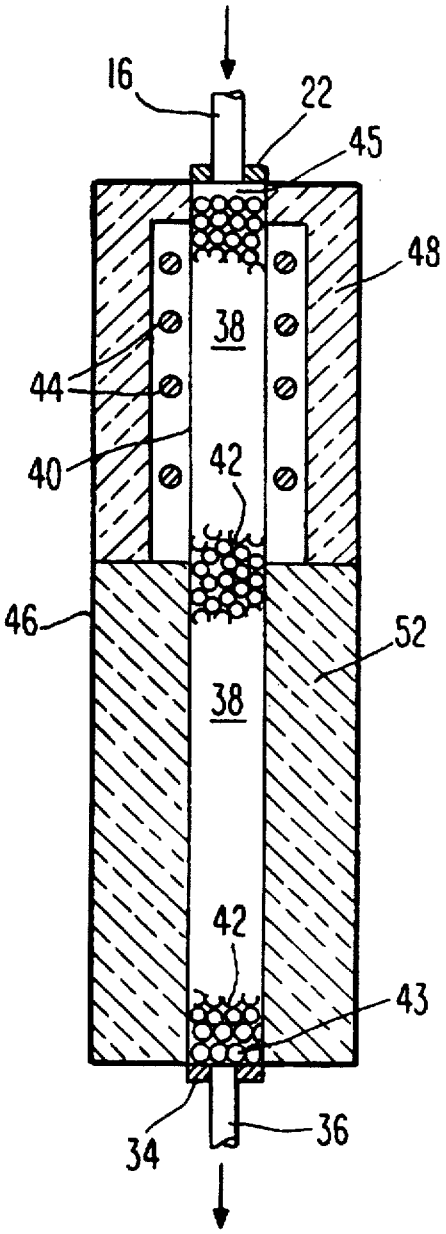
FIG. 3 is a cross-sectional schematic diagram of an alternative embodiment of the flameless oxidizer of the present invention.

As a further alternative, shown in FIG. 3, the matrix bed (38) can be extended through the convective quench region to the oxidizer outlet (34). In this embodiment, the convective quench is based on a variety of heat exchange devices: forced convection from the gas to the matrix bed containment shell (40), forced convection from the gas to the heat resistant material (42), radiation from the heat resistant material (42) to the matrix bed containment shell (40), conduction across the matrix bed containment shell (40), radiation from the matrix bed containment shell (40) to the quench insulation (42), conduction across the quench insulation (42), conduction across the outer containment shell (46), and radiation, natural convection, and forced convection from the outer containment shell (46) to the ambient environment.

FIGS. 1 and 2 indicate that the oxidizer (20) input stream from line (16) enters the flameless oxidizer (20) at the bottom and that the gaseous products exit the flameless oxidizer (20) via line (36) at the top. FIG. 3 indicates an opposite configuration, i.e., line (16) enters the flameless oxidizer (20) at the top and the gaseous products exit via line (36) at the bottom. The present invention will operate in either configuration. Given the current sizing of such flameless oxidizers, it is believed that the top down configuration is preferable to allow for ease of access to the heating elements (44). This is advantageous because it is believed that the only significant components that will require regular maintenance in the apparatus of the present invention are the heating elements (44) and the matrix bed containment shell (40). Thus, for example, the matrix bed containment shell (40) can constitute a cartridge that can be removed from the flameless oxidizer (20) as a unit for maintenance purposes.

There typically will be, but not necessarily, a plenum (43), preferably made of a heat-resistant material such as a layer or two of larger diameter ceramic balls or a perforated plate, at the bottom of the matrix bed (38) to prevent the heat resistant material (42) from entering the piping below the matrix bed (38). If the flow pattern is set up such that the oxidizer input stream from line (16) enters the flameless oxidizer (20) at the bottom, this plenum (43) will act to evenly distribute incoming gases and further mix these gases prior to entering the matrix bed (38). It is believed that this helps to achieve a relatively flat cross-sectional profile of the oxidation wave perpendicular to the direction of the flow of the gases through the matrix bed (38). In some instances the plenum (43) may be desirable to achieve the flatness of the cross-section of the wave, depending on the configuration of the matrix bed (38).

If the flow pattern is set up such that the oxidizer input stream enters the flameless oxidizer (20) via line (16) at the top, such as in FIG. 3, the function of the plenum—distributing the incoming gases—will be achieved through the use of a void space (45) over the top of the matrix bed (38). This void space (45) will preferably be present regardless of whether the flow pattern is top to bottom or bottom to top to allow for any expansion of the heat resistant material (42) contained in the matrix bed (38).

If a plenum of brick or ceramic balls is used, it will typically comprise a section with very low radial pressure drop, so that cross-sectional gas distribution is maximized. Convenient means for mixing the gases and/or air prior to entering the matrix bed (38) may also be utilized, such as a venturi-type or twisted insert static gas-air mixer.

Figure 4:
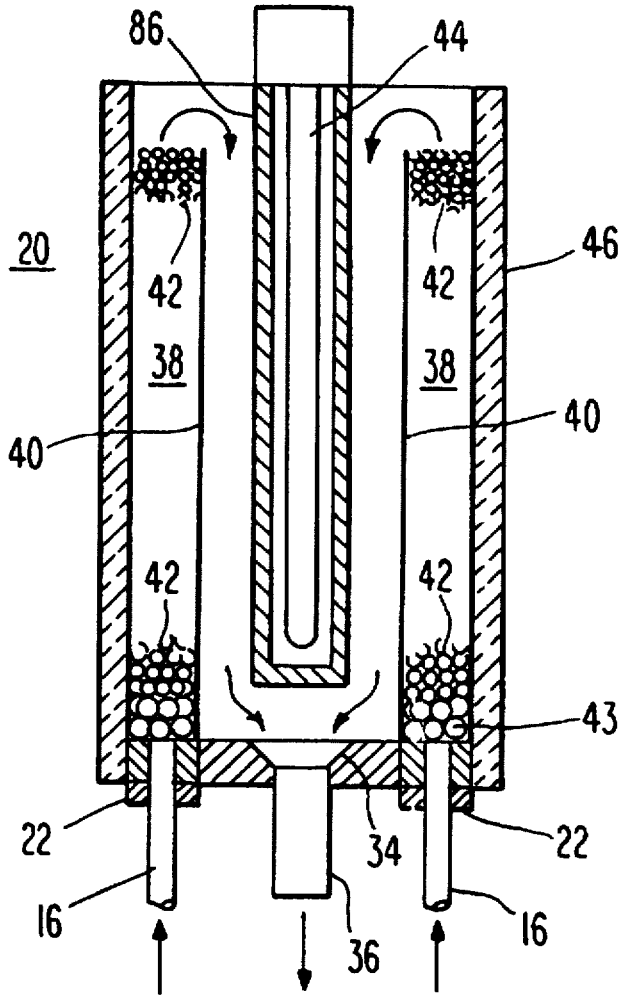
FIG. 4 is a cross-sectional schematic diagram of an alternative embodiment of the flameless oxidizer of the present invention.

An alternative design for the flameless oxidizer (20) is shown in FIG. 4. In this embodiment, the matrix bed containment shell (40) and the outer containment shell (46) form an annular region that is filled with the heat resistant material (42) to form the matrix bed (38). The gases enter the oxidizer (20) via lines (16), flows through the matrix bed (38), in which the gases are oxidized, and the product gases then exit the oxidizer (20) through the exit (34) via line (36). The oxidizer (20) is heated by the electric heating element (44), which is protected by an inner containment wall (86).

Typical materials used to construct the matrix bed (38) are made of ceramic materials, which may be randomly packed or structurally packed. Preferred random packing comprises ceramic balls that may be layered. Generally, for oxidation of hydrocarbon gases, the ceramic balls are useful if they have a diameter from about 0.0625 to 3 inches (0.159–7.62 cm), preferably about ¾ inch (1.9 cm). Another useful configuration is the use of random ceramic saddles typically from 0.0625 to 3 inch (0.159–7.62 cm) nominal size, preferably about ½ to 1.5 inches (1.27–3.81 cm) nominal size. Other useful packing materials are pall rings and raschig rings with diameters from about 0.0625 to 3 inches (0.159–7.62 cm), and preferably from about ½ to 1.5 inches (1.27–3.81 cm). Other shapes of ceramic material may be utilized such as honeycomb shape ceramic.

A ceramic foam material may also be utilized to construct the matrix bed (38). Typical foam material that can be utilized has a void fraction of 10 to 99%, preferably 75 to 95%, and most preferably about 90%. The pore sizes in any preferred ceramic foam material will be about 0.1 to 1,000 pores per inch (0.04 to 400 pores per cm), preferably about 1 to 100 pores per inch (0.4 to 40 pores per cm), and most preferably about 10 to 30 pores per inch (4 to 12 pores per cm).

Instead of a ceramic, the heat-resistant material used to form the matrix bed (38) may also be a metal, which may be randomly packed or may have a structured packing. A pre-designed, single piece metal structure can also be used to constitute the matrix bed (38), which structure can be secured to the containment shell (40) and thereby easily removed for maintenance purposes.

It is preferred that the materials that constitute the matrix bed (38) are non-catalytic. The destruction of the organic compounds, and the complete oxidation of CO, within the flameless oxidizer (20) using the preferred ceramic, non-catalytic matrix materials (42) is conducted at relatively high temperatures exceeding 1400° F., and generally between about 1550° F. to about 1800° F. These temperatures exceed the autoignition temperature of the gaseous mixture that constitutes the gaseous stream exiting the primary treatment unit. The autoignition temperature of the gaseous mixture is that temperature where spontaneous chain reactions occur between the organic compounds and oxygen within the gas phase.

Generally, the void fraction of the matrix bed will be between 0.3 and 0.9. In addition, the material in the matrix bed will typically have a specific surface area ranging from 40 $m^2/m^3$ to 1040 $m^2/m^3$.

The flow of the process gas stream through the primary treatment unit (14) and the flameless oxidizer (20) can be created by any conventional means such as a blower located on line (12) (not shown) or a pump located on line (36) or (72) (not shown). It is preferred to use a suction pump so that a slight negative pressure exists within the flameless oxidizer (20) for safety reasons.

Thus, the basics of the preferred embodiments of the flameless oxidizer of the present invention have been disclosed. Many variations on, and additions to, these basic embodiments are also possible.

Typically, the flameless oxidizer (20) will contain various temperature sensors (54), as shown in FIG. 2, to detect unacceptably high or low temperatures within the matrix bed (38) and thereby control the heating elements (44). Preferably, if excessively high temperatures are detected at the exit of the flameless oxidizer (20), then a thermal safety valve will fail and close to shut off all flow.

Also typically, the entire system will be sequenced and operated by a locally mounted process controller (30), which will provide sequencing, control, and safety monitoring. The process controller (30) will receive analog and digital inputs from several instruments mounted in the system, including thermocouples and level switches. It will control flameless oxidizer temperatures during the preheat and operation steps by modulating current to the electric heating elements (44) via lines (62) to provide for a controlled system heat-up and for maintenance of oxidation temperature at destruction set points. It will also continuously monitor all system safety interlocks and will shut the system down in a safe manner upon detection of a tripped interlock.

In one preferred embodiment of the present invention, the temperature sensors (54), which sense the temperature at various positions within the matrix bed (38) along the gas flowpath, are electronically connected to the process controller (30) via line (64). The process controller (30) can then control the amount of supplemental fuel and/or air fed to the gases coming into the flameless oxidizer (20) via line (16). As shown in FIG. 1, the supplemental fuel and/or air are introduced into the waste stream gases in line (16) prior to entering the flameless oxidizer (20).

However, in certain embodiments, and in particular when the gases within line (16) are at a high temperature (depending on the type of primary treatment unit utilized), the supplemental fuel and/or air may be added directly into the matrix bed (38), or even the plenum (43), section of the flameless oxidizer (20) as shown in FIG. 2. The addition of the supplemental air/fuel by this mode is preferred when the temperature of the gases entering the oxidizer exceed at least about 400° F., preferably at least about 750° F., and more preferably at least about 1000° F. In FIG. 2, the supplemental air is added via line (65) and the supplemental fuel is added via line (66) through the aid of air valve (67) and fuel valve (68). The process controller (30) would regulate such flows by being electronically wired to valves (67) and (68) by way of lines (69) and (70), respectively. In such a way, the process controller (30) serves to monitor and control the position of the oxidation wave established within the matrix bed (38).

The flameless oxidizer (20) has been shown in the present invention to be heated by electric heating elements. The heat to maintain a useful bed temperature can also come from the addition of supplemental fuel. However, the heat is preferably added to the oxidizer by means of the electric heating elements since the overall volume of process gases within the overall treatment system is thereby minimized. In such a way, the pollution control equipment that exists downstream of the flameless oxidizer (20) can process a lower volume of gases. For similar processing advantages, it is preferred to use oxygen gas instead of supplemental air in lines (24) and (65).

In a preferred embodiment, the overall processing system can be designed to achieve VOC destruction in the flameless oxidizer (20) instead of in the primary treatment unit (14). This design reduces the need to supply oxygen or air to the primary treatment unit (14) and thereby reduces explosion concerns associated with that unit. Also, the oxygen or air can be blended with the waste gas stream exiting the primary treatment unit (14) in a controlled manner for a controlled VOC destruction within the flameless oxidizer (20). This type of a design greatly reduces the amount of air required for oxidation of the organic waste as the oxidation efficiency is greater in the flameless oxidizer (20) as opposed to the primary treatment unit (14). Thus, the gas volume load on the associated gas treatment units downstream from the flameless oxidizer (20) is substantially reduced.

The advantage of using a flameless oxidizer (20) to handle the process of oxidizing the organic components present in the waste stream is particularly beneficial when using the aqueous-based primary treatment units (14), which operate with water/water vapor/steam as the carrier fluid. Such primary treatment units (14) include the aqueous decomposition processors, the hydrothermolytic processors, and the steam reformers. These units typically convert at least about 75%, more commonly at least about 90%, by volume of the organic compounds in the waste stream (12) to partial or full oxidation products—CO, $CO_2$, $H_2$, and $H_2O$, under normal operating conditions. However, the flameless oxidizer (20) is a much more efficient processing unit in which to destroy the organic waste compounds than these aqueous-based primary treatment units.

Thus, in a preferred embodiment of the present invention the primary treatment unit (14) comprises an aqueous-based unit that is operated under processing conditions that do not necessitate extensive decomposition of the organic compounds to oxidation products such as CO, $CO_2$, $H_2$, and $H_2O$. Preferably the primary treatment unit (14) would be operated under such conditions that less than 50%, preferably less than 25%, and more preferably less than 15%, and in some cases less than 10%, by volume of the organic compounds present in the waste stream (12) are oxidized to such compounds as CO, $CO_2$, $H_2$, and $H_2O$.

The decomposition of the organic compounds within these aqueous-based primary treatment units can be limited in ways that do not decrease the overall efficiency of the process, but rather in ways that increase the overall efficiency of the process. Indeed, this is the driving factor for utilizing the flameless oxidizer (20) as the primary unit for the decomposition, by oxidation, of the organic compounds. One way to increase the overall process efficiency, and limit the extent of decomposition within these primary treatment units, is to increase the flow rate of the waste stream (12) entering the primary treatment unit (14), thereby decreasing the residence time of the waste within the primary treatment unit (14). In such a way, the primary treatment unit is actually operated well beyond its design capacity (when substantial organic decomposition is designed for normal operation) and functions primarily as a separation unit to produce a gaseous stream containing the organic compounds (16) and an inorganic and metal stream (18) as shown in FIG. 1. As another alternative, in designing a new processing system, a much smaller primary treatment unit (14) can be used because it must function only to separate the organic compounds from the other waste stream components and does not have to decompose the organic compounds. In yet another alternative, the processing within the primary treatment unit (14) can be halted after the separation of the organic compounds has been satisfactorily completed by way of operating the pretreatment unit in a batch-type mode instead of a continuous processing mode.

These process designs provide an additional benefit in accordance with the present invention in that the organic compounds, not being extensively decomposed in the primary treatment unit (14), carry with them chemical energy into the oxidizer (20). This chemical energy is released within the oxidizer (20) during the oxidation process and is used to maintain the elevated temperatures required within the oxidizer (20). Thus, less supplemental fuel and/or electrical heat energy is required to maintain the matrix bed temperature at the operating conditions.

The safety of the overall process can be enhanced by not requiring oxidation to occur within the primary treatment unit (14) along with separation of the organic/non-organic components. In prior system designs, the presence of air/oxygen in the primary treatment unit presented a potentially dangerous situation because the organic compounds were in contact with $O_2$ in high temperature combustive conditions. Various of the primary treatment units are not as well suited with respect to the safety of the destruction of organic compounds as the designs associated with flameless oxidizers. Thus, the safety of the overall process can be improved by moving the oxidation function to the oxidizer.

As shown in FIG. 1, by using the flameless oxidizer (20) as the principal unit for oxidizing the organic compounds present within the waste stream (12), an aqueous-based primary treatment unit can be employed to separate the organic compounds into stream (16) for transport to the oxidizer (20) and the inorganic/metal compounds into stream (18) for transport to an encapsulation unit (19). The encapsulation unit (19) can be any of the non-aqueous primary treatment units (14) described herein such as a plasma-arc centrifugal furnace, a vitrification furnace, and a molten metal/salt processor. The encapsulation unit (19) can also be a system that stores the waste components in a suitable container. Thus, the encapsulation unit (19) is generally described as any processing unit that can encapsulate the inorganic/metal components of the waste stream either in a matrix material or in a suitable containment vessel.

In a still further preferred embodiment, the overall system is designed in a "closed loop" fashion. In this design, the process gases exiting the flameless oxidizer (20) via line (34) are recycled back to the primary treatment unit (14) via line (72) by closing valve (74). These gases will comprise $CO_2$, $H_2O$, and the particular carrier fluid employed with the particular primary treatment unit (14) technology. To ensure a proper mass balance, the process gases within line (72) are treated in a $CO_2$ removal unit (76) to remove $CO_2$ from the process gas stream. Any conventional technology can be used to remove the $CO_2$ from the process gas stream, with one such method being contacting the process gas stream with lithium hydroxide. The $CO_2$ is removed from the system via line (78). The carrier fluid is then recycled to the primary treatment unit (14) via line (80). In the event that the carrier fluid does not include water, the water formed from the oxidation of the organic waste materials can be removed from the process gases that are recycled via line (72) in the optional water removal unit (82) using conventional technologies, such as condensation. The removed water can be drained from the system via line (84).

Although the present invention has been described above with respect to particular preferred embodiments, it will be apparent to those skilled in the art that numerous modifications and variations can be made to those designs. The descriptions provided are for illustrative purposes and are not intended to limit the invention.

What is claimed is:

1. A method for treating commingled waste, comprising the steps of:

(a) feeding a commingled waste stream into a primary treatment unit, said commingled waste comprising organic material and inorganic material;

(b) separating a portion of the organic material from the inorganic material in said primary treatment unit and decomposing a portion of the organic material into decomposition products comprising CO, $CO_2$, $H_2$, and $H_2O$ in said primary treatment unit to form an organic gas stream comprising at least CO or volatile organic compounds, wherein the portion of the organic material decomposed in said primary treatment unit is less than 75% by volume of the organic material;

(c) removing said organic gas stream from said primary treatment unit;

(d) feeding said organic gas stream at a temperature of at least 400° F. into a first portion of a matrix bed of heat resistant material contained within a flameless oxidizer;

(e) injecting supplemental air, oxygen, fuel, or combinations thereof into said first portion of said matrix bed to react with said organic gas stream;

(f) heating said organic gas stream to a temperature of at least 1400° F. in said matrix bed and oxidizing the volatile organic compounds or CO into gaseous products in an oxidation wave within said matrix bed.

2. The method of claim 1 further comprising heating said matrix bed to a temperature of at least 1400° F. by means of an electric heater that surrounds at least a portion of said matrix bed.

3. The method of claim 2 wherein the primary treatment unit converts less than 50% by volume of the organic compounds to decomposition products comprising CO, $CO_2$, $H_2$, and $H_2O$.

4. The method of claim 2 wherein the primary treatment unit converts less than 25% by volume of the organic compounds to decomposition products comprising CO, $CO_2$, $H_2$, and $H_2O$.

5. The method of claim 2 wherein said primary treatment unit comprises a plasma-arc centrifugal furnace, a vitrification furnace, a molten metal/salt processor, a steam reformer, a hydrothermolytic processor, or an aqueous decomposition processor.

6. The method of claim 1 wherein said primary treatment unit comprises a plasma-arc centrifugal furnace, a vitrification furnace, or a molten metal/salt processor.

7. The method of claim 1 wherein said primary treatment unit comprises an aqueous based primary treatment unit.

8. The method of claim 7 wherein said primary treatment unit comprises a steam reformer, a hydrothermolytic processor, or an aqueous decomposition processor.

9. The method of claim 7 wherein the primary treatment unit converts less than 50% by volume of the organic compounds to decomposition products comprising CO, $CO_2$, $H_2$, and $H_2O$.

10. The method of claim 7 further comprising removing the separated inorganic material from the primary treatment unit and processing the inorganic material in an encapsulation unit.

11. The method of claim 10 wherein the encapsulation unit comprises a plasma-arc centrifugal furnace, a vitrification furnace, or a molten metal/salt processor.

12. A method for treating commingled waste, comprising the steps of:

(a) feeding a commingled waste stream into a primary treatment unit, said commingled waste comprising organic material and inorganic material, and feeding a carrier fluid into said primary treatment unit;

(b) separating a portion of the organic material from the inorganic material in said primary treatment unit and decomposing a portion of the organic material into decomposition products comprising CO, $CO_2$, $H_2$, and $H_2O$ in said primary treatment unit to form an organic gas stream comprising at least CO or volatile organic compounds and said carrier fluid, wherein the portion of the organic material decomposed in said primary treatment unit is less than 75% by volume of the organic material;

(c) removing said organic gas stream and at least a portion of said carrier fluid as a post-primary treatment unit carrier fluid from said primary treatment unit;

(d) feeding said organic gas stream at a temperature of at least 400° F. into a first portion of a matrix bed of heat resistant material contained within a flameless oxidizer;

(e) injecting supplemental air, oxygen, fuel, or combinations thereof into said first portion of said matrix bed to react with said organic gas stream;

(f) heating said organic gas stream to a temperature of at least 1400° F. in said matrix bed and oxidizing the volatile organic compounds or CO into gaseous products comprising $CO_2$ in an oxidation wave within said matrix bed; and (g) recycling at least a portion of said post primary treatment unit carrier fluid from the oxidizer to said primary treatment unit.

13. The method of claim 12 further comprising heating said matrix bed to a temperature of at least 1400° F. by means of an electric heater that surrounds at least a portion of said matrix bed.

14. The method of claim 12 wherein the primary treatment unit converts less than 50% by volume of the organic compounds to decomposition products comprising CO, $CO_2$, $H_2$, and $H_2O$.

15. The method of claim 12 wherein the primary treatment unit converts less than 25% by volume of the organic compounds to decomposition products comprising CO, $CO_2$, $H_2$, and $H_2O$.

16. The method of claim 12 wherein said primary treatment unit comprises a plasma-arc centrifugal furnace, a vitrification furnace, a molten metal/salt processor, a steam reformer, a hydrothermolytic processor, or an aqueous decomposition processor.

17. The method of claim 12 wherein an exit gas comprising $CO_2$, $H_2O$, and the post-primary treatment unit carrier fluid exits the flameless oxidizer, and wherein said recycling step further comprises removing $CO_2$ from said exit gas.

18. The method of claim 12 wherein said primary treatment unit comprises a plasma-arc centrifugal furnace, a vitrification furnace, or a molten metal/salt processor.

19. The method of claim 12 wherein said primary treatment unit comprises an aqueous based primary treatment unit.

20. The method of claim 19 wherein said primary treatment unit comprises a steam reformer, a hydrothermolytic processor, or an aqueous decomposition processor.

21. The method of claim 19 wherein the primary treatment unit converts less than 50% by volume of the organic compounds to decomposition products comprising CO, $CO_2$, $H_2$, and $H_2O$.

22. The method of claim 19 further comprising removing the separated inorganic material from the primary treatment unit and processing the inorganic material in an encapsulation unit.

23. The method of claim 22 wherein the encapsulation unit comprises a plasma-arc centrifugal furnace, a vitrification furnace, or a molten metal/salt processor.

24. A process system for treating commingled waste, comprising:

(a) a primary treatment unit having an inlet, an organic gas stream outlet, an inorganic/metal stream outlet, a means for separating organic material from inorganic material contained in the commingled waste, and a means for decomposing a portion of the organic material into decomposition products comprising CO, $CO_2$, $H_2$, and $H_2O$; and (b) a flameless oxidizer comprising (1) an inlet for receiving a gaseous stream from the gas outlet of the primary treatment unit;

(2) an outlet for removing reaction gaseous products from the flameless oxidizer; and (3) a gaseous oxidation section located between the inlet and the outlet comprising a matrix bed of non-catalytic, heat resistant material; and (4) a heater for heating at least a portion of the oxidation section including a portion of the matrix bed of heat resistant material to a temperature exceeding at least about 1400° F.; and (5) means for injecting a controllable amount of supplemental air, oxygen, fuel or combinations thereof into said flameless oxidizer.

25. The process system of claim 24 wherein said primary treatment unit comprises a plasma-arc centrifugal furnace, a vitrification furnace, a molten metal/salt processor, a steam reformer, a hydrothermolytic processor, or an aqueous decomposition processor.

26. The process system of claim 25 wherein the system further comprises a recycle gas loop in flow communication with the outlet of the flameless oxidizer and the primary treatment unit.

27. The process system of claim 26 further comprising carbon dioxide removal means in flow communication with said recycle loop to remove carbon dioxide.

28. The process system of claim 26 further comprising water removal means in flow communication with said recycle loop to remove water.

29. The process system of claim 24 wherein said heater is an electric heater.

30. The process system of claim 24 wherein said primary treatment unit comprises a plasma-arc centrifugal furnace, a vitrification furnace, or a molten metal/salt processor.

31. The process system of claim 24 wherein said primary treatment unit comprises a steam reformer, a hydrothermolytic processor, or an aqueous decomposition processor.

32. The process system of claim 31 further comprising an encapsulation unit having an inlet in flow communication with the inorganic/metal stream outlet of the primary treatment unit.

33. The process system of claim 32 wherein said encapsulation unit comprises a plasma-arc centrifugal furnace, a vitrification furnace, or a molten metal/salt processor.

34. A method for treating commingled waste, comprising the steps of:

(a) feeding a commingled waste stream and electrolytic aqueous solution into an aqueous decomposition processor, the commingled waste comprising organic material and inorganic material;

(b) reacting at least a portion of the organic material in the aqueous decomposition processor to at least partially oxidize or reduce the organic material;

(c) vaporizing at least a portion of the reacted organic material and water to form an organic gas stream comprising at least CO, $H_2O$, and volatile organic compounds;

(d) removing the organic gas stream from the aqueous decomposition processor;

(e) feeding the organic gas stream into a first portion of a matrix bed of heat resistant material contained within a flameless oxidizer, wherein the first portion of the matrix bed is maintained at a temperature of at least 1400° F.; and (f) oxidizing the volatile organic compounds or CO into gaseous products in an oxidation wave within the first portion of the matrix bed.

* * * * *

UNITED STATES PATENT AND TRADEMARK OFFICE

CERTIFICATE OF CORRECTION

PATENT NO. : 5,770,784

DATED : June 23, 1998

INVENTOR(S) : Ann C. Heywood, Mark R. Holst, Richard J. Martin, John T. Schofield and Alexander G. Baldwin It is certified that error appears in the above-indentified patent and that said Letters Patent is hereby corrected as shown below:

On title page, item

[75] Inventors: Ann C. Heywood, Danville; Mark R. Holst, Concord; Richard J. Martin, San Jose, all of Calif.; John T. Schofield, Villanova, PA and Alexander G. Baldwin, Oakridge, TN Signed and Sealed this Third Day of November, 1998

*Attest:*

Bruce Lehman

BRUCE LEHMAN

*Attesting Officer*

*Commissioner of Patents and Trademarks*